US006370253B1

(12) United States Patent
Onishi et al.

(10) Patent No.: US 6,370,253 B1
(45) Date of Patent: Apr. 9, 2002

(54) SOUND REPRODUCING DEVICE

(75) Inventors: Masahide Onishi; Fumiyasu Konno; Akinori Hasegawa, all of Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/486,449

(22) PCT Filed: Jun. 29, 1999

(86) PCT No.: PCT/JP99/03502

§ 371 Date: May 25, 2000

§ 102(e) Date: May 25, 2000

(87) PCT Pub. No.: WO00/02416

PCT Pub. Date: Jan. 13, 2000

(30) Foreign Application Priority Data

Jul. 1, 1998 (JP) ..... 10-185973

(51) Int. Cl.[7] ..... H04R 3/00

(52) U.S. Cl. ..... 381/98; 381/97; 381/59; 381/56

(58) Field of Search ..... 381/96, 97, 98, 381/56, 57, 59, 113, 120

(56) References Cited

U.S. PATENT DOCUMENTS 6,122,385 A * 9/2000 Konno et al. ..... 381/96

FOREIGN PATENT DOCUMENTS

JP 1-282996 11/1989
JP 5-30588 2/1993

OTHER PUBLICATIONS

Japanese search report for PCT/JP99/03502 dated Aug. 24, 1999.

English translation of Form PCT/ISA/210.

* cited by examiner

*Primary Examiner*—Minsun Oh Harvey
(74) *Attorney, Agent, or Firm*—Ratner & Prestia

(57) ABSTRACT

A signal produced by a speaker is removed from a totaled sound of noise around the speaker and the signal from the speaker, thereby extracting correctly the noise around. This structure allows an audio reproducing apparatus of the present invention to masking compensation more naturally. This audio reproducing apparatus includes a detecting coil (17) disposed on a bobbin (16) of the speaker (13), and a microphone (15) disposed around the speaker (13). An output signal from the detecting coil (17) and an output signal from the microphone (15) are respectively filtered, and then undergo an adding process. An input signal is adjusted its magnitude based on these processed signals.

32 Claims, 8 Drawing Sheets

SOUND REPRODUCING DEVICE

This application is a U.S. national phase application of PCT international application PCT/JP99/03502.

TECHNICAL FIELD

The present invention relates to an audio reproducing apparatus for reproducing a quality signal in a rather noisy environment.

BACKGROUND ART

FIG. 8 is a block diagram illustrating a conventional audio reproducing apparatus. In FIG. 8, an input signal received by input terminal 1 is fed into power amplifier 3 via gain-control-circuit 2. An output signal supplied from power amplifier 3 is fed into speaker 4 mounted to baffle 5 and then reproduced. Microphone 6 disposed around speaker 4 collects signals radiated from speaker 4 together with the noises around baffle 5. An output signal supplied from microphone 6 and the output signal from amplifier 3 are fed into subtractor 7, where the input signal component is deducted from the sum of the radiated signal from speaker 4 and the noise around, thereby extracting the noise component around baffle 5. An output signal supplied from subtractor 7 is proportionate to the noise around and restricts a bandwidth of the noise around via low-pass-filter 8. An output supplied from low-pass-filter 8 is converted from ac to dc by rectifying circuit 9 and then supplied to gain-control-circuit 2 disposed at a stage before amplifier 3. This structure allows gain-control-circuit 2 to change automatically an amplitude of an input signal responsive to the noise around speaker 4 so that the signal radiated from speaker 4 can be prevented from being masked by the noise around.

However, a conventional audio reproducing apparatus produces a difference between a signal component radiated from speaker 4 and that supplied from amplifier 3, thus subtractor 7 cannot completely remove the signal component radiated from speaker 4. Therefore, the noise component around the speaker is hard to be extracted, whereby the noises within only a limited bandwidth can be restricted.

SUMMARY OF THE INVENTION

The present invention aims to provide an audio reproducing apparatus that removes a signal radiated from a speaker correctly, and changes a gain responsive to noises around.

In order to achieve this objective, the audio reproducing apparatus of the present invention prepares a microphone disposed around a speaker and a detecting means for detecting a movement of a voice coil of the speaker. The microphone and the detecting means extract a noise component around. This structure allows the noise component around the speaker to be extracted correctly, so that masking compensation can be performed in a natural manner.

DETAILED DESCRIPTION OF EXEMPLARY EMBODIMENT (Exemplary Embodiment 1)

The exemplary embodiment of the present invention is demonstrated hereinafter with reference to the accompanying drawings.

Figure 1:
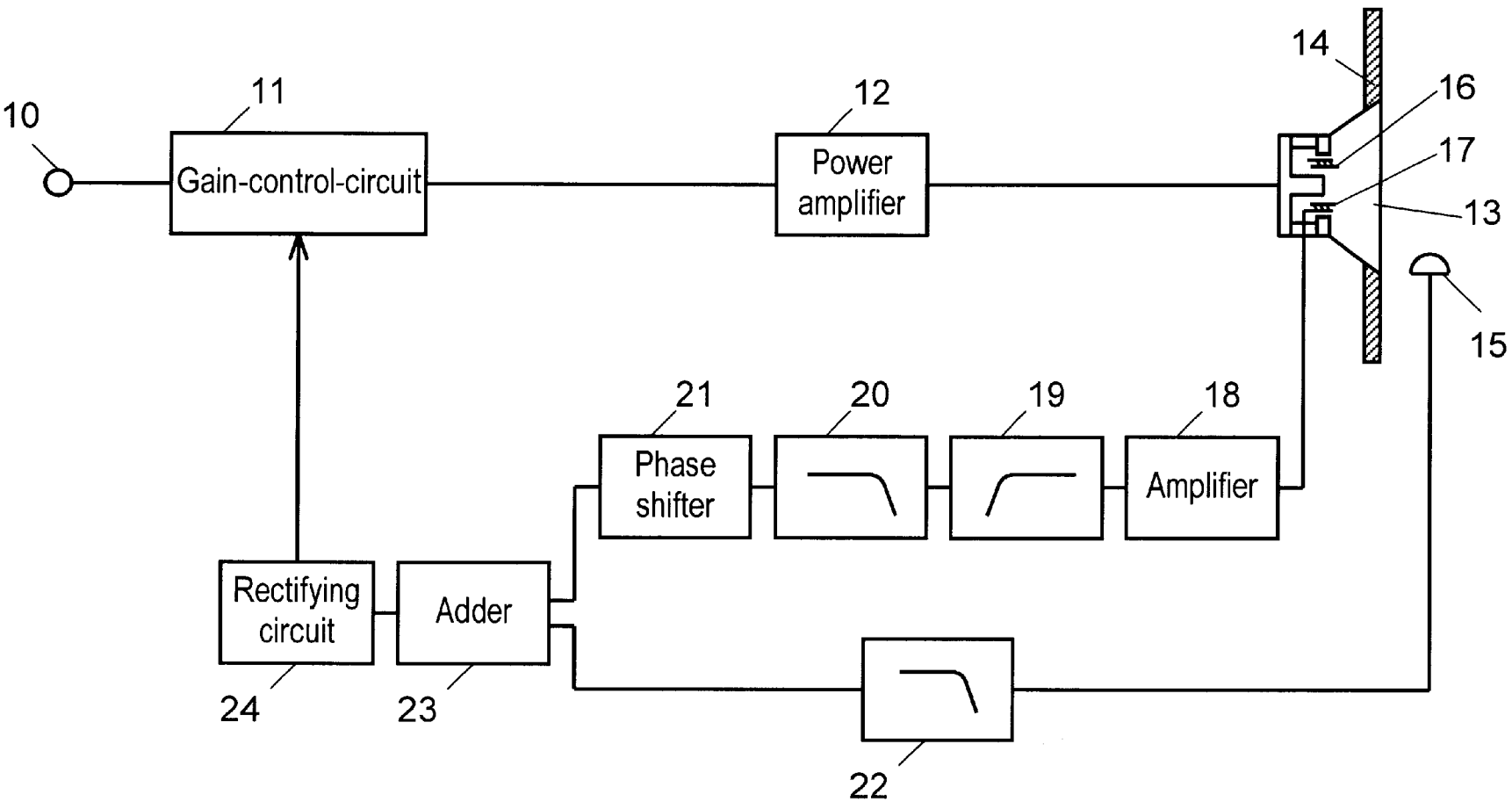
FIG. 1 is a block diagram illustrating an audio reproducing apparatus in accordance with an exemplary embodiment of the present invention.

FIG. 1 is a block diagram illustrating an audio reproducing apparatus in accordance with the exemplary embodiment of the present invention. In FIG. 1, a signal fed into input terminal 10 is supplied to gain-control-circuit 11, which is controlled by a signal responsive to noises around. This signal is detailed later. An output from gain-control-circuit 11 is fed into power amplifier 12, and an output signal from amplifier 12 is supplied to speaker 13 mounted to baffle 14. Microphone 15 is disposed ahead of speaker 13, thereby collecting a signal radiated from speaker 13 together with the noise around and ahead of speaker 13. Further, in speaker 13, detecting coil 17 is provided to bobbin 16 on which voice coil is wound. Detecting coil 17 outputs a signal proportionate to a vibration speed of the voice coil. An output of detecting coil 17 is amplified by amplifier 18, then the output undergoes high-pass-filter 19 and a first low-pass-filter 20, thereby obtaining a signal—passing a desirable bandwidth for masking compensation—out of the signal components radiated from speaker 13. Second low-pass-filter 22 extracts noise component from an output of microphone 15. Next, an output of first low-pass-filter 20 undergoes phase-shifter 21 so that this output has a phase reverse to the output of second low-pass-filter 22. An output of phase shifter 21 and the output of second low-pass-filter 22 are both fed into adder 23, whereby the signal component radiated from speaker 13 is removed. As a result, the noise collected by microphone 15 from around and ahead of speaker 13 can be solely taken out. This output from adder 23, i.e. noise component around and ahead of speaker 13, is supplied to rectifying circuit 24 to convert an ac signal to a dc signal, then this dc signal is supplied to gain-control-circuit 11. This structure allows a gain to be automatically changed responsive to the noise around the speaker. Thus more natural masking compensation is expected. This mechanism is further detailed hereinafter.

Figure 2:
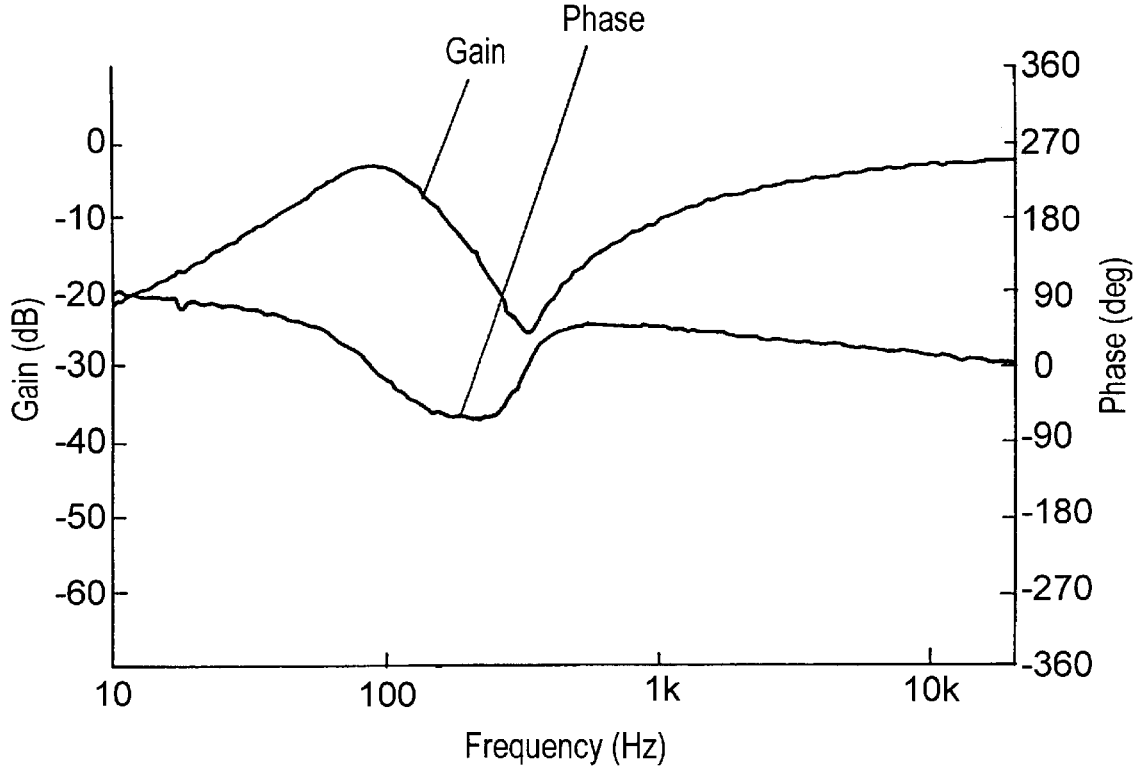
FIG. 2 shows characteristics of an output from a detection coil of the apparatus.
Figure 3:
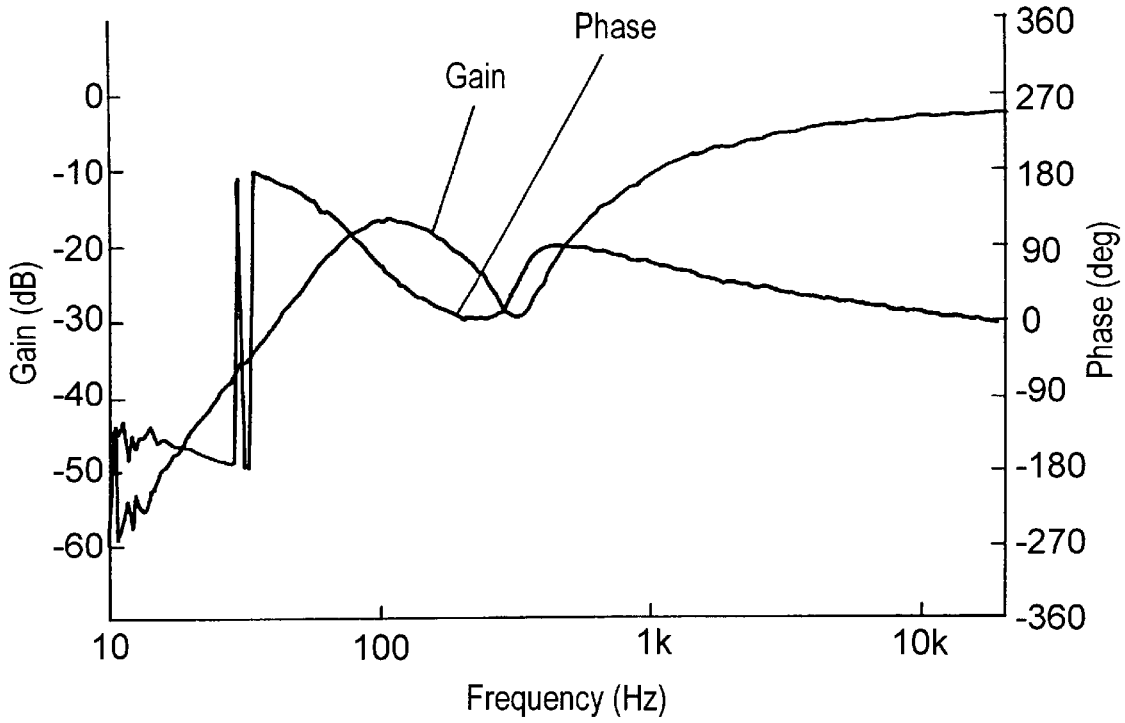
FIG. 3 shows characteristics of an output from a high-pass-filter of the apparatus.
Figure 4:
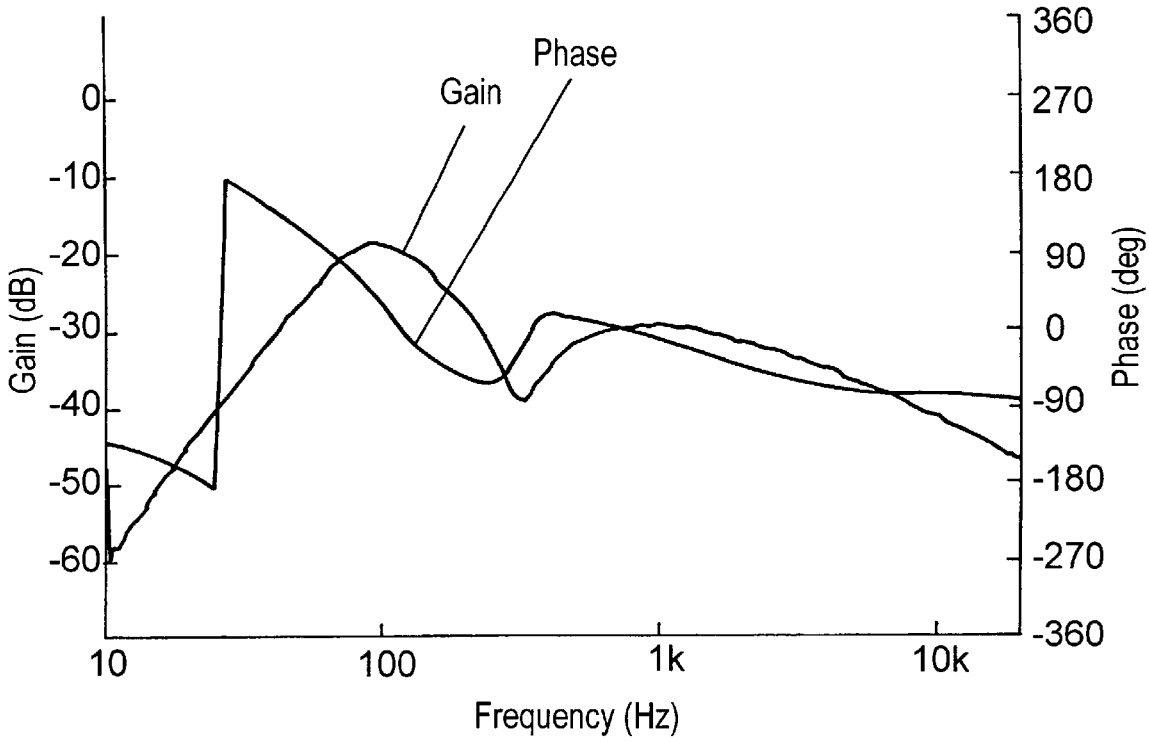
FIG. 4 shows characteristics of an output from a first low-pass-filter of the apparatus.

FIG. 2 shows characteristics of frequency and phase of an output signal supplied from detecting coil 17. The output signal from coil 17 shows the characteristics proportionate to a vibration speed of bobbin 16 on which a voice coil is wound. In FIG. 2, the phase becomes 0 (zero) degree at the frequency of 87 Hz. FIG. 3 shows characteristics of frequency and phase of an output signal from detecting coil 17. This output signal has run through the secondary high-pass-filter 19 having a 87 Hz cutoff frequency. In FIG. 3, the phase becomes 45 degree at the frequency of 118 Hz. FIG. 4 shows characteristics of frequency and phase of an output signal from detecting coil 17. This output signal has run through the primary first low-pass-filter 20 having 118 Hz cutoff frequency.

Figure 5:
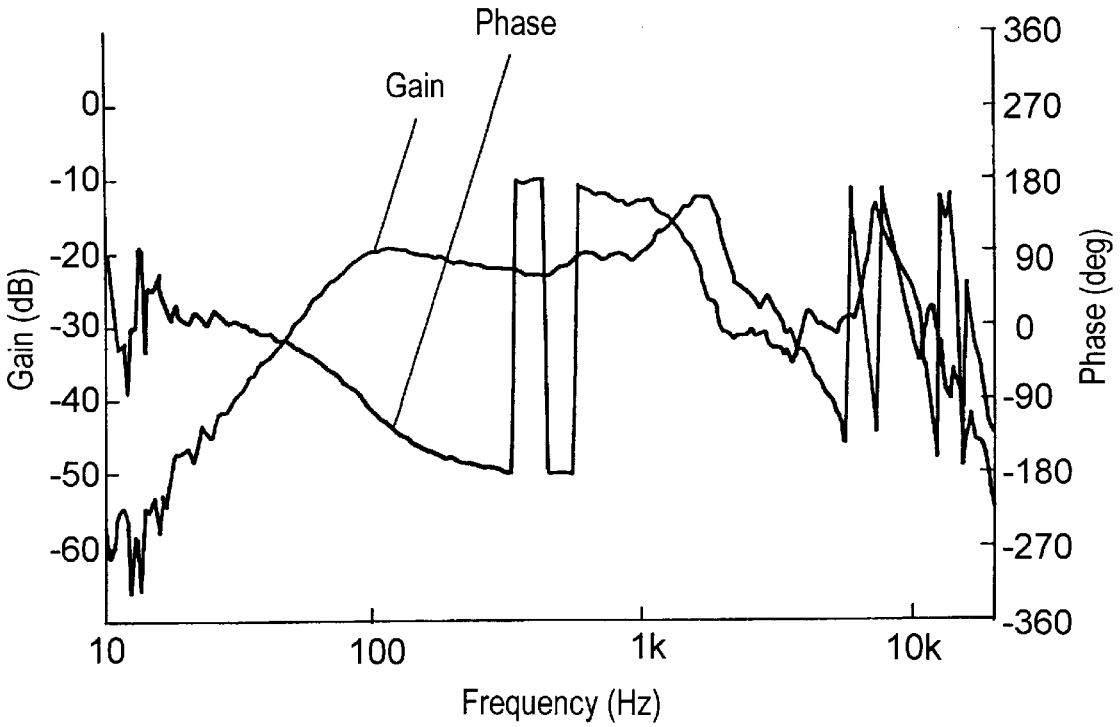
FIG. 5 shows characteristics of an output from a microphone of the apparatus.
Figure 6:
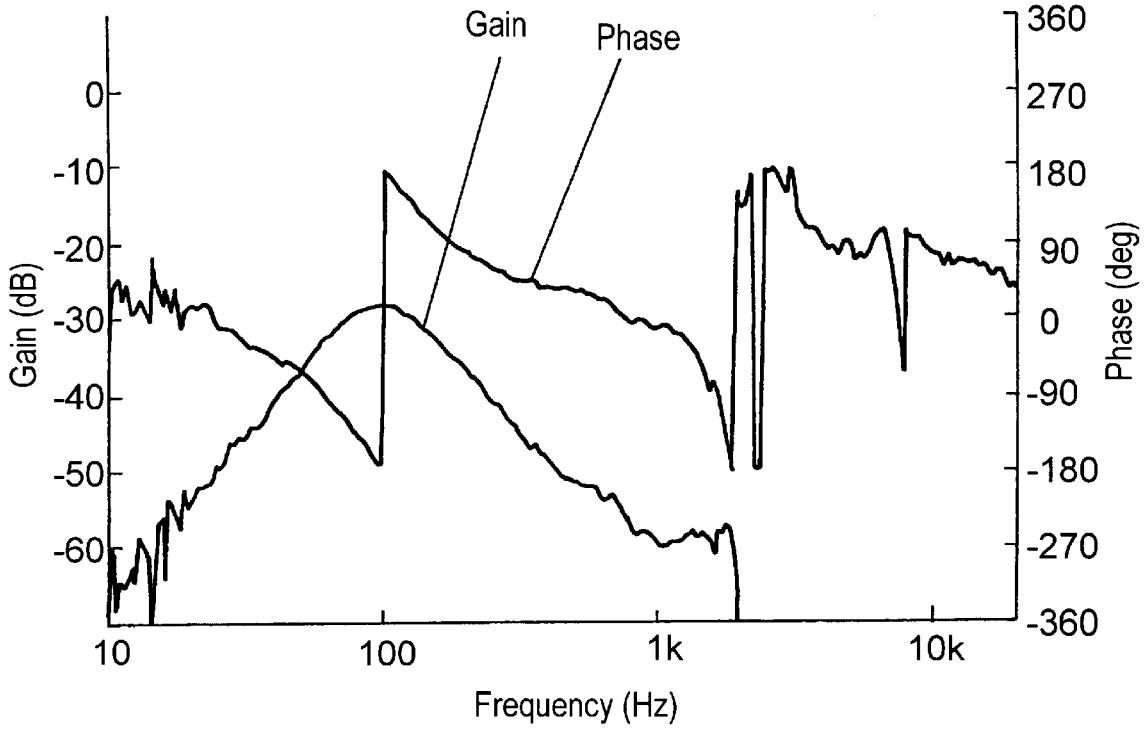
FIG. 6 shows characteristics of an output from a second low-pass-filter of the apparatus.
Figure 7:
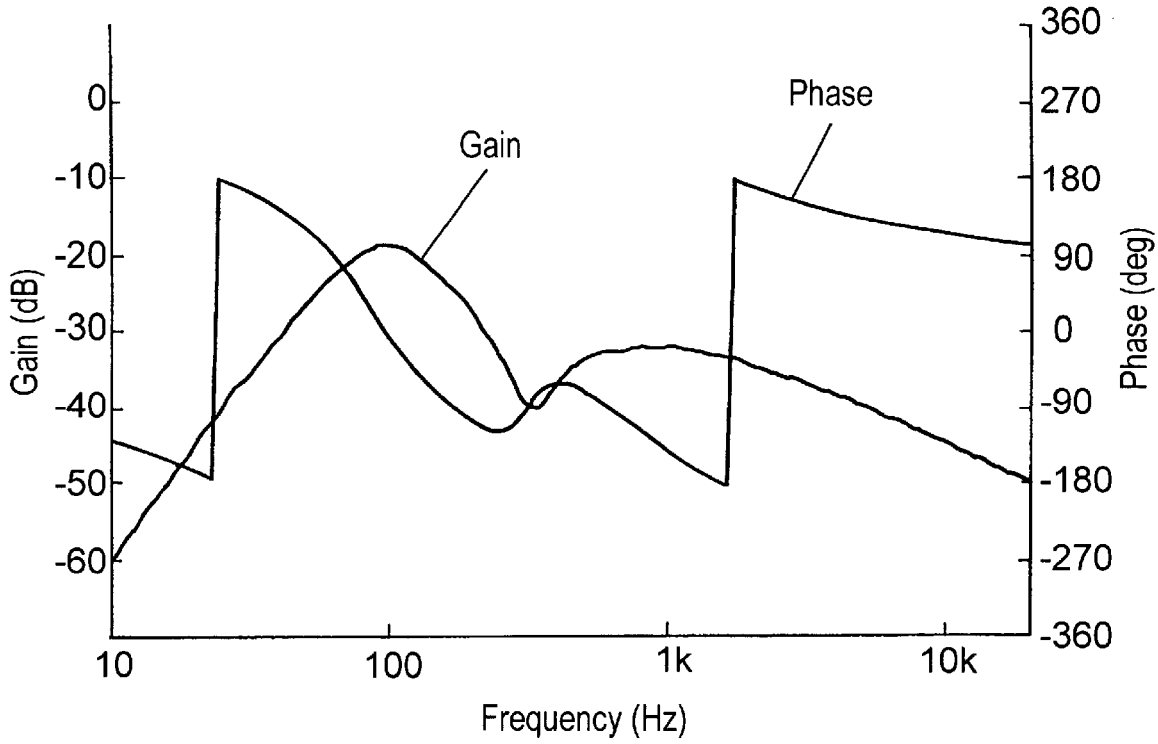
FIG. 7 shows characteristics of an output from a phase shifter of the apparatus.
Figure 8:
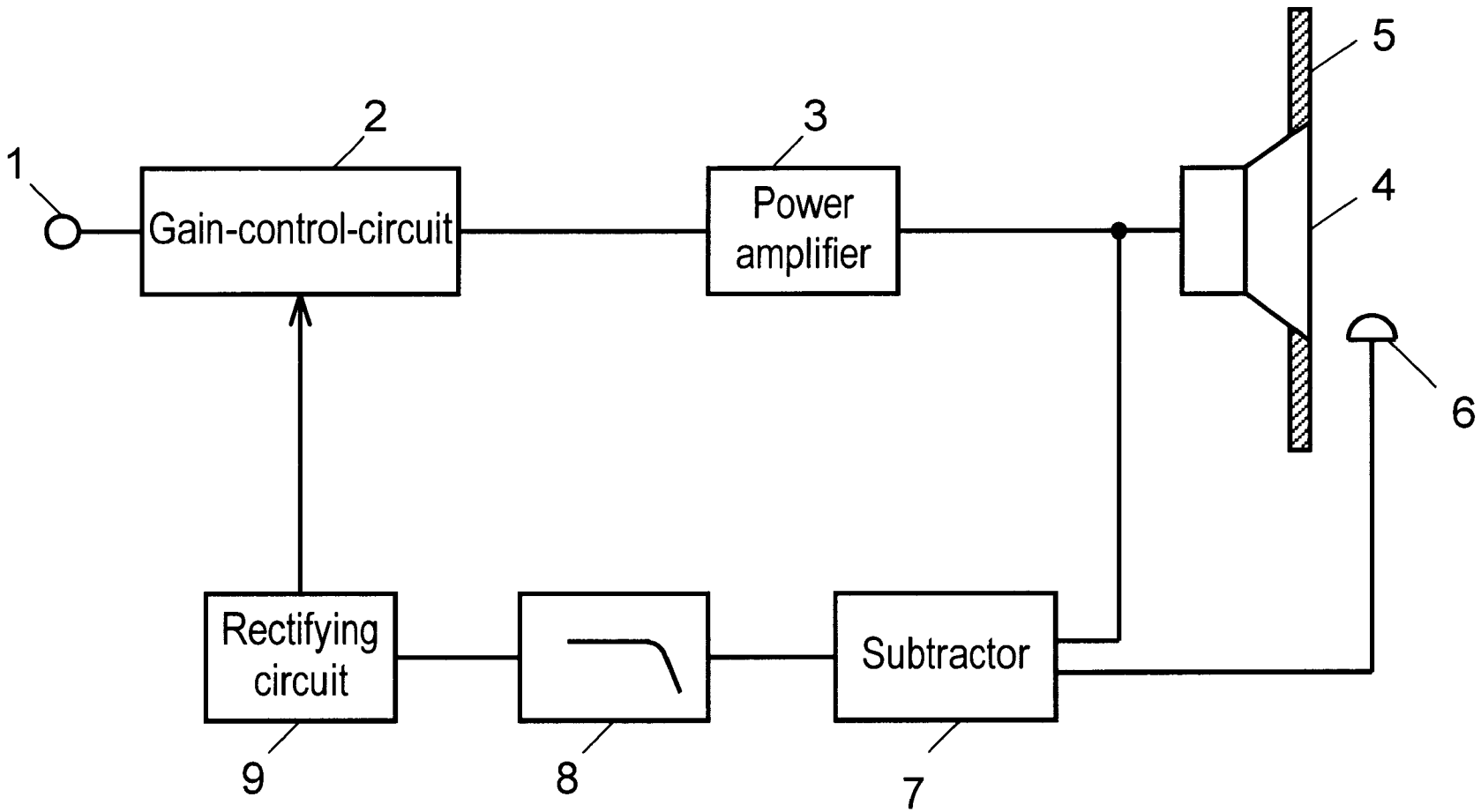
FIG. 8 is a block diagram illustrating a conventional audio reproducing apparatus.

FIG. 5 shows characteristics of frequency and phase of an output from microphone 15. As shown in FIG. 5, a signal radiated from speaker 13 shows the same characteristics as that of the output passed the secondary high-pass-filter. FIG. 6 shows characteristics of frequency and phase of the output signal from microphone 15. This output signal has run through the primary second low-pass-filter 22 of which cutoff frequency is 118 Hz. In FIG. 6, the phase characteristic becomes—180 degree at the frequency of 100 Hz. FIG. 7 shows characteristics of frequency and phase of the output signal from detecting coil 17. This output signal has run through phase shifter 21 which is set for a phase to be 0 degree at the frequency of 100 Hz. As shown in FIG. 6 and FIG. 7, the output signal from detecting coil 17 and that from microphone 15 have the frequency characteristics that pass approximately the same bandwidth, and the phases thereof are reverse with each other. These signals are fed into adder 23 whereby the signal component radiated from speaker 13 is removed. As a result, only the noise collected by microphone 15 from around and ahead of speaker 13 can be taken out.

In this first embodiment, microphone 15 is disposed around and ahead of speaker 13 on the assumption that the noise source is ahead of the speaker. When the noise source is behind speaker 13, microphone 15 is disposed around and back of speaker 13 so that the masking compensation can be more correctly performed. In this case, the phases of respective signals can be reverse with each other by selecting a coupling method of detecting coil 17 or a type of amplifier 18, and as a result, the same effect can be produced.

In this first embodiment, a detecting coil is used as detecting means. However, a piezoelectric pick-up producing electric charges responsive to a movement of the voice coil or an element converting the stress change due to the movement of the voice coil into a resistance change can also function as detecting means. In this case, an output from the detecting means and the output from microphone 15 desirably have the same characteristic, i.e. these signals run through the same bandwidth, and are in reverse phases with each other so that the same effect can be produced. In order to realize this mechanism, high-pass-filter 19, first low-pass-filter 20, phase-shifter 21, and second low-pass-filter 22 are desirably adjusted appropriately.

INDUSTRIAL APPLICABILITY

An output from detecting means of voice coil movement of a speaker and an output from a microphone disposed around the speaker are both filtered so that a signal component supplied from the speaker is removed. Thus only the noise around the speaker is correctly taken out, and this output is converted to a dc signal by a rectifying circuit and then supplied to a gain-control-circuit where a gain can be changed automatically responsive to the noise around the speaker. As a result, audio reproduction free from being masked with the noise around is achievable.

What is claimed is:

1. An audio reproducing apparatus comprising:

(a) a power amplifier for amplifying an input signal;

(b) a speaker for reproducing an output signal from said power amplifier, said speaker being mounted to a baffle;

(c) detecting means for detecting a movement of a voice coil disposed in said speaker;

(d) a microphone disposed around said speaker;

(e) an amplifier for amplifying an output signal supplied from said detecting means;

(f) a bandwidth-passing-means for an output supplied from said amplifier;

(g) a phase shifter for receiving an output signal from said bandwidth-passing-means;

(h) adding means for adding electrically an output from said phase shifter and a lower frequency component of an output signal, including a noise around and a signal reproduced by said speaker, from said microphone;

(i) converting means for converting an ac signal supplied from said adding means into a dc signal; and (j) control means for adjusting automatically a magnitude of the input signal responsive to the dc signal supplied from said converting means for preventing a reproduced sound from being masked with noise around said speaker, said control means disposed on an input side of said amplifier.

2. The audio reproducing apparatus as defined in claim 1 wherein said detecting means is a detecting coil disposed at a bobbin wound with a voice coil of said speaker.

3. The audio reproducing apparatus as defined in claim 1 wherein said bandwidth-passing-means comprises a low-pass-filter and a high-pass-filter.

4. The audio reproducing apparatus as defined in claim 1, further comprising a low-pass-filter disposed between an input side of said adding means and an output side of said microphone.

5. The audio reproducing apparatus as defined in claim 1, wherein said converting means is a rectifying circuit.

6. The audio reproducing apparatus as defined in claim 1, wherein said control means is a gain-control-circuit for controlling an amplitude of the input signal responsive to the dc signal supplied from said converting means.

7. The audio reproducing apparatus as defined in claim 1 wherein said microphone is disposed ahead of said speaker.

8. The audio reproducing apparatus as defined in claim 1 wherein said microphone is disposed behind said speaker.

9. The audio reproducing apparatus as defined in claim 2 wherein said bandwidth-passing-means comprises a low-pass-filter and a high-pass-filter.

10. The audio reproducing apparatus as defined in claim 2 further comprising a low-pass-filter disposed between an input side of said adding means and an output side of said microphone.

11. The audio reproducing apparatus as defined in claim 3, further comprising a low-pass-filter disposed between an input side of said adding means and an output side of said microphone.

12. The audio reproducing apparatus as defined in claim 9, further comprising a low-pass-filter disposed between an input side of said adding means and an output side of said microphone.

13. The audio reproducing apparatus as defined in claim 2 wherein said converting means is a rectifying circuit.

14. The audio reproducing apparatus as defined in claim 3 wherein said converting means is a rectifying circuit.

15. The audio reproducing apparatus as defined in claim 4 wherein said converting means is a rectifying circuit.

16. The audio reproducing apparatus as defined in claim 9 wherein said converting means is a rectifying circuit.

17. The audio reproducing apparatus as defined in claim 10 wherein said converting means is a rectifying circuit.

18. The audio reproducing apparatus as defined in claim 11 wherein said converting means is a rectifying circuit.

19. The audio reproducing apparatus as defined in claim 2, wherein said control means is a gain-control-circuit for controlling an amplitude of the input signal responsive to the dc signal supplied from said converting means.

20. The audio reproducing apparatus as defined in claim 3, wherein said control means is a gain-control-circuit for controlling an amplitude of the input signal responsive to the dc signal supplied from said converting means.

21. The audio reproducing apparatus as defined in claim 4 wherein said control means is a gain-control-circuit for controlling an amplitude of the input signal responsive to the dc signal supplied from said converting means.

22. The audio reproducing apparatus as defined in claim 5 wherein said control means is a gain-control-circuit for controlling an amplitude of the input signal responsive to the dc signal supplied from said converting means.

23. The audio reproducing apparatus as defined in claim 9 wherein said control means is a gain-control-circuit for controlling an amplitude of the input signal responsive to the dc signal supplied from said converting means.

24. The audio reproducing apparatus as defined in claim 10 wherein said control means is a gain-control-circuit for controlling an amplitude of the input signal responsive to the dc signal supplied from said converting means.

25. The audio reproducing apparatus as defined in claim 11 wherein said control means is a gain-control-circuit for controlling an amplitude of the input signal responsive to the dc signal supplied from said converting means.

26. The audio reproducing apparatus as defined in claim 12 wherein said control means is a gain-control-circuit for controlling an amplitude of the input signal responsive to the dc signal supplied from said converting means.

27. The audio reproducing apparatus as defined in claim 13 wherein said control means is a gain-control-circuit for controlling an amplitude of the input signal responsive to the dc signal supplied from said converting means.

28. The audio reproducing apparatus as defined in claim 14 wherein said control means is a gain-control-circuit for controlling an amplitude of the input signal responsive to the dc signal supplied from said converting means.

29. The audio reproducing apparatus as defined in claim 15 wherein said control means is a gain-control-circuit for controlling an amplitude of the input signal responsive to the dc signal supplied from said converting means.

30. The audio reproducing apparatus as defined in claim 16 wherein said control means is a gain-control-circuit for controlling an amplitude of the input signal responsive to the dc signal supplied from said converting means.

31. The audio reproducing apparatus as defined in claim 17 wherein said control means is a gain-control-circuit for controlling an amplitude of the input signal responsive to the dc signal supplied from said converting means.

32. The audio reproducing apparatus as defined in claim 18 wherein said control means is a gain-control-circuit for controlling an amplitude of the input signal responsive to the dc signal supplied from said converting means.

* * * * *